US005938465A

United States Patent [19]

Fox, Sr.

[11] Patent Number: 5,938,465

[45] Date of Patent: Aug. 17, 1999

[54] MACHINED DUAL SPRING RING CONNECTOR FOR COAXIAL CABLE

[75] Inventor: Roy W. Fox, Sr., Winsted, Conn.

[73] Assignee: Palco Connector, Inc., Naugatuck, Conn.

[21] Appl. No.: 08/951,134

[22] Filed: Oct. 15, 1997

[51] Int. Cl.[6] ..... H01R 13/627

[52] U.S. Cl. ..... 439/350; 439/578

[58] Field of Search ..... 439/271, 349, 439/350, 357, 578

[56] References Cited

U.S. PATENT DOCUMENTS

| | | | |
|---|---|---|---|
| 2,677,811 | 5/1954 | Anderson et al. . | |
| 3,193,309 | 7/1965 | Morris . | |
| 3,336,566 | 8/1967 | Barker . | |
| 3,352,576 | 11/1967 | Thorne-Thomsen . | |
| 3,793,610 | 2/1974 | Brishka . | |
| 4,072,386 | 2/1978 | Wallo . | |
| 4,929,188 | 5/1990 | Lionetto et al. | 439/349 |
| 5,195,904 | 3/1993 | Cyvoct . | |
| 5,288,242 | 2/1994 | Muzslay | 439/349 |
| 5,295,864 | 3/1994 | Birch et al. . | |
| 5,704,809 | 1/1998 | Davis | 439/349 X |

FOREIGN PATENT DOCUMENTS

| | | | |
|---|---|---|---|
| 3700511 | 7/1988 | Germany | 439/349 |

*Primary Examiner*—Khiem Nguyen
*Attorney, Agent, or Firm*—DeLio & Peterson LLC

[57] ABSTRACT

An axially mating quick connect-disconnect electrical connector comprising a plug member and a jack member is provided. A split spring ring having a circumferential notch therein is carried by the plug member in a peripheral groove as the connective member and when the two connectors are joined the ring is compressed reducing the diameter of the ring and the periphery of the ring is compressed toward the notch resulting in a dual compression of the ring which is mated in an inner, circumferential groove in the jack and provides the necessary connection forces between the plug and jack members while providing for connection or disconnection of the two connectors using less force than typically needed for such connectors.

23 Claims, 3 Drawing Sheets

MACHINED DUAL SPRING RING CONNECTOR FOR COAXIAL CABLE

BACKGROUND OF THE INVENTION

1. Field of the Invention

The present invention relates to a connector of the type having a male element (plug) and a female element (jack) which elements are joined by pushing the elements together or separated by pulling them apart, and, in particular, to a coaxial cable electrical connector which requires a lower connection-disconnection force than conventional connectors while still maintaining effective electrical connection of the plug and jack elements.

2. Description of Related Art

The need to connect electrical wires and, in particular, coaxial cables, is well-known in the art. Typically, each cable has a connector at one end and the connectors are mated together by insertion of one into the other. The cables and connectors may be retained together by means of threaded members. For some applications, however, quick connect-disconnect connectors are required whereby the cables are connected without the use of external locking means such as threaded members but are held together by forcing the two connectors together and disconnected by pulling them apart. For such axially engaged connectors, it is required that there be a positive locking means such as a split ring to prevent accidental unmating of the connectors resulting from tension applied to the connector cables.

In general, locking features have generally been expensive and typically require additional connector parts such as sleeve locks, etc. and a number of patents have been issued in this area.

U.S. Pat. No. 3,336,566 to Barker discloses a microwave push-on connector including an isolation ring 31. The isolation ring is intended to prevent signal leakage out of the small gaps found in conventional push-on connectors. The isolation ring includes two components, each having multiple fingers 36 and 37 which are arranged so that the gaps between adjacent fingers are covered by the underlining or overlying ring. U.S. Pat. No. 3,793,610 to Brishka discloses an axially mating connector with a split ring 70 having chamfered edges. U.S. Pat. No. 5,195,904 to Cyvoct discloses a coaxial electrical connector having a split annular keeper 18 of a generally v-shaped cross-section with a truncated apex.

An important application using a quick connect-disconnect female and male connector is to connect a coaxial cable or other cable to a printed circuit board. The printed circuit board has a mating connector attached thereto (typically the female connector) and the cable is connected to the male connector and is connected or disconnected by applying an axial force to the male connector and the female connector attached to the printed circuit board. The cables and connectors are relatively small and the connectors are usually less than about ¼ inch although larger sized connectors may be employed and are contemplated herein. It is important that the connect and particularly the disconnect force be relatively low to prevent damage to the board.

Bearing in mind the problems and deficiencies of the prior art, it is therefore an object of the present invention to provide a plug connector and a jack connector for connecting electrical wires, e.g., coaxial cables, which connectors may be mated by forcing them together or disconnected by pulling them apart and which connectors provide an inexpensive positive locking means to prevent accidental unmating of the connectors and which require a relatively low force to connect-disconnect the connectors compared to prior art connectors.

A further object of the invention is to provide as an article of manufacture, a split spring ring which is used with a plug connector and a jack connector to lock the plug connector and jack connector together, e.g., coaxial cable connectors, and which ring allows connection and disconnection of the connector using a relatively lower force than conventional split spring rings.

Another object of the invention is to provide as an article of manufacture a cable secured to a connector, which connector may be connected to another mating connector or disconnected from another mating connector by an axial force.

Still other objects and advantages of the invention will in part be obvious and will in part be apparent from the specification.

SUMMARY OF THE INVENTION

The above and other objects, which will be apparent to those skilled in the art, are achieved in the present invention which is directed in a first aspect to a plug connector and a jack connector for connecting coaxial cable or other electrical wiring, which connectors are mated by pushing the connectors together and disconnected by pulling the connectors apart wherein the plug connector comprises a connector body generally cylindrical having an outer circumferential groove at the periphery of the body and having a split spring ring therein, the ring having an inner diameter greater than the inner diameter of the groove and preferably having a circular, rounded outer periphery and a notch or opening therein preferably on one side of the ring wherein when the plug connector is inserted by force into the jack connector the axial force on the connectors provides a radially inward force on the ring so that the ring is compressed reducing the diameter of the ring and the periphery of the ring is compressed toward the notch or opening resulting in a dual compression of the ring allowing the ring to be mated in an inner circumferential groove in the jack using less force than for conventional split spring rings. The mated ring is constrained in the inner circumferential groove in the jack connector to provide a positive connection securing the plug and jack connectors together. When disconnecting the connectors, the pulling force provides a similar dual disconnect spring action in the spring by compressing both the diameter of the spring ring and the periphery of the ring toward the notch in the ring resulting in a dual compression of the ring enabling disconnection of the connectors using less force than needed for conventional split spring rings.

In a further aspect of the invention, the split spring ring is formed with generally parallel opposed sidewalls which lie in a plane substantially perpendicular to the longitudinal axis of the connectors and a curved periphery joining the opposed sidewalls. In a preferred aspect, the ring is formed to comprise generally parallel opposed sidewalls and both a flat peripheral inner edge and a curved peripheral outer edge.

In an additional aspect of the invention, the ring has a vertical axis and a horizontal axis with the horizontal axis lying in a plane substantially parallel to the longitudinal axis of the connector. The ring has an inner edge and an outer edge and may be circular in cross-section but preferably has a straight inner edge and a curved outer edge. The notch is preferably in the central portion of the ring and has a lower wall substantially parallel to the horizontal axis and an upper wall having an angle of less than 90° with the lower wall, typically 10–30°, e.g., 17°. The notch also preferably extends past the midpoint of the ring and extends around the periphery of the ring. The split ring is preferably machined to form the notch, but the notch and/or ring may be made using any suitable fabrication techniques. The notch or opening may also be along the vertical axis.

In a preferred aspect of the invention, an electrical connector which is axially mating is provided comprising:

a first connector member having a first electrical contact therein;

a second connector member having an axial bore therein for receiving the first member and a second electrical contact therein for electrical connection with said first electrical contact upon mating of said first and second connector members;

an outer groove in the periphery of said first connector member;

radially deformable split spring ring means carried by the outer groove in said first connector member wherein the inner diameter of the spring ring is slightly larger than the inner diameter of the outer groove and the ring has a circumferential notch therein;

an inner circumferential groove (or undercut) in said second connector member;

wherein when the first connector is slideably engaged with the second connector, the spring ring is contacted with the second connector providing a radially inward force on the spring ring with the spring ring being compressed and the spring ring mating with the inner groove of the second connector member when the first connector member and second member are mated.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
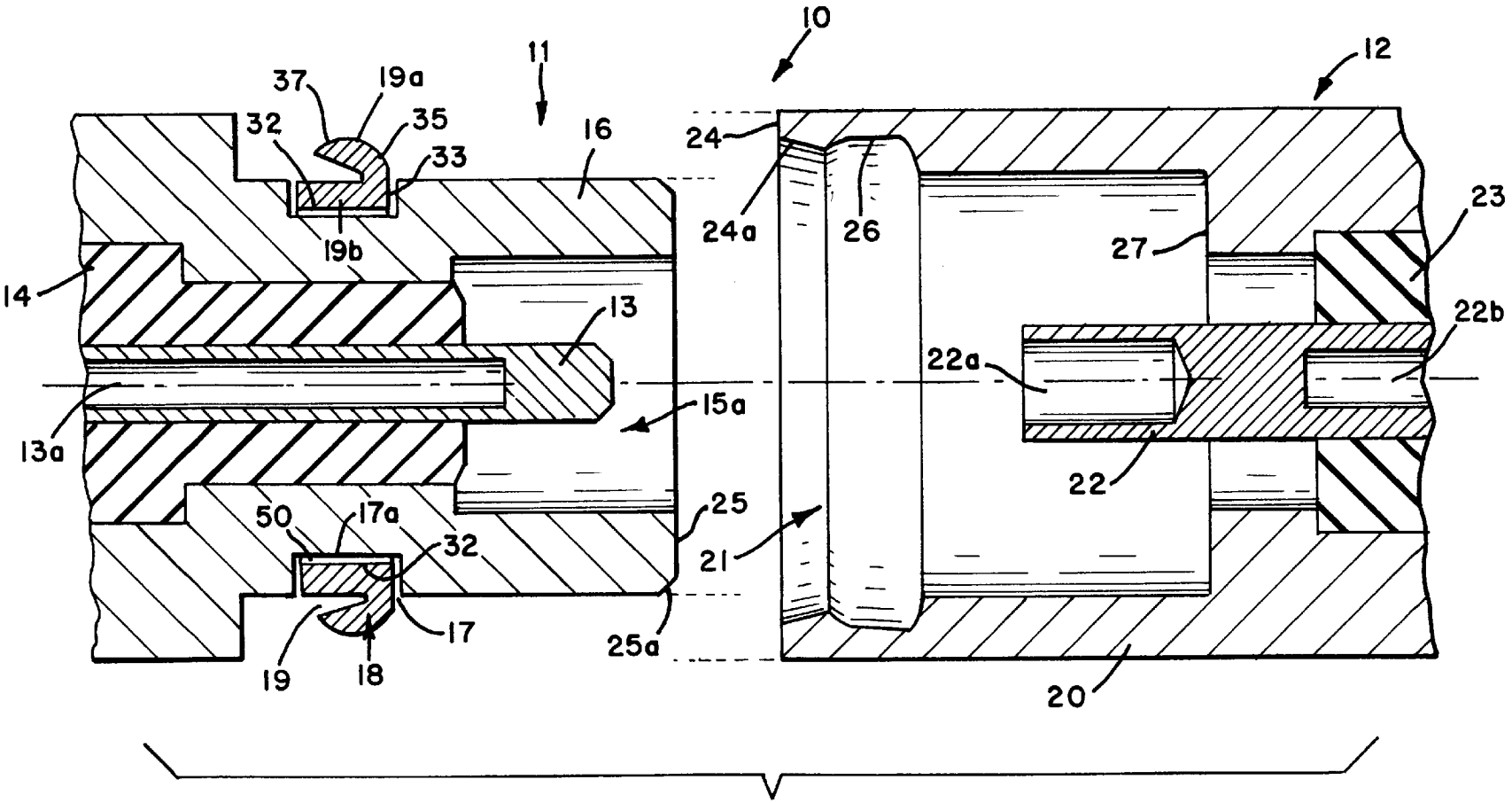
FIG. 1 is a longitudinal cross-sectional view of part of a connector of the present invention showing both the receptacle (jack) connector member and male (plug) connector member disengaged from each other.

In describing the preferred embodiments of the present invention, reference will be made herein to FIGS. 1–5D of the drawings in which like numerals refer to like features of the invention. Features of the invention are not necessarily shown to scale in the drawings.

Referring to FIG. 1, there is shown a mating pair of connector members for coaxial cable generally disignated as 10 which comprise a plug (male) connector 11 and a receptacle (female) connector 12. Other types of connectors having different configurations of inner insulation, conductors, etc., may suitably be employed using the split spring ring locking member of the invention with the plug connector only requiring an outer peripheral groove to hold the ring and the jack connector only requiring an inner groove into which the split spring ring mates and secures the plug and jack connectors together.

A male center contact pin 13 having a bore 13*a* to receive a cable conductor is mounted in an annular insulator 14. The insulator 14 is mounted in a main body 16 of plug connector 11. A front annular opening 15*a* is formed at the forward end of the plug connector 11. Broadly stated, a coaxial cable (not shown) is stripped of its insulation and the central conductor inserted into bore 13*a*. The main body 16 is then crimped or other means used to secure the cable to the connector 11.

The plug connector main body 16 has a circumferential groove 17, behind the forward face 25 of the main body. Tapered edge 25*a* allows easier connection of the plug and jack connectors. A split in the circular spring ring 18 is used to provide resiliency to the ring which is formed of a suitable spring material such as steel, steel alloys, copper, copper alloys, plastic and the like and is positioned in the groove 17. The inner diameter of the ring shown by edge 32 is slightly larger than the inner diameter 17*a* of the groove 17 providing a space 50 to allow compression of the ring during connect disconnect operations. When such an operation is done, the ring is deformed and contracts in diameter when a force is applied and, in particular, when an axial force is applied which produces a radially inwardly-directed force to the ring when the plug 11 is inserted into jack 12 or removed from jack 12. The ring 18 when it is mated within inner groove 26 in receptacle connector 12 provides a compressive holding force in the jack main body 20. The circular split spring ring 18 has a circumferential notch 19 therein in the left side of the ring to provide a second spring action when a force is applied to the ring and the dual spring action as described below provides the enhanced connect-disconnect features of connectors of the present invention.

The receptacle connector 12 includes a receptacle main body 20 formed with a forward annular recess 21. A female socket contact 22 is coaxially positioned within the receptacle main body 20 and is separated therefrom by annular insulation 23. The receptacle female socket 22 has an opening 22*a* therein which will receive the male center contact pin 13 of plug connector 11. At the rear of receptacle female socket 22 is a bore 22*b* which will receive the central conductor of the cable to be connected to the connector. As for the plug connector described above, in a typical coaxial cable, an outer conductor having an outer layer of insulation is separated from the central conductor by inner insulation. The outer conductor and central conductor are stripped from the insulation and the central conductor secured in bore 22*b* typically by crimping main body 20.

Figure 2:
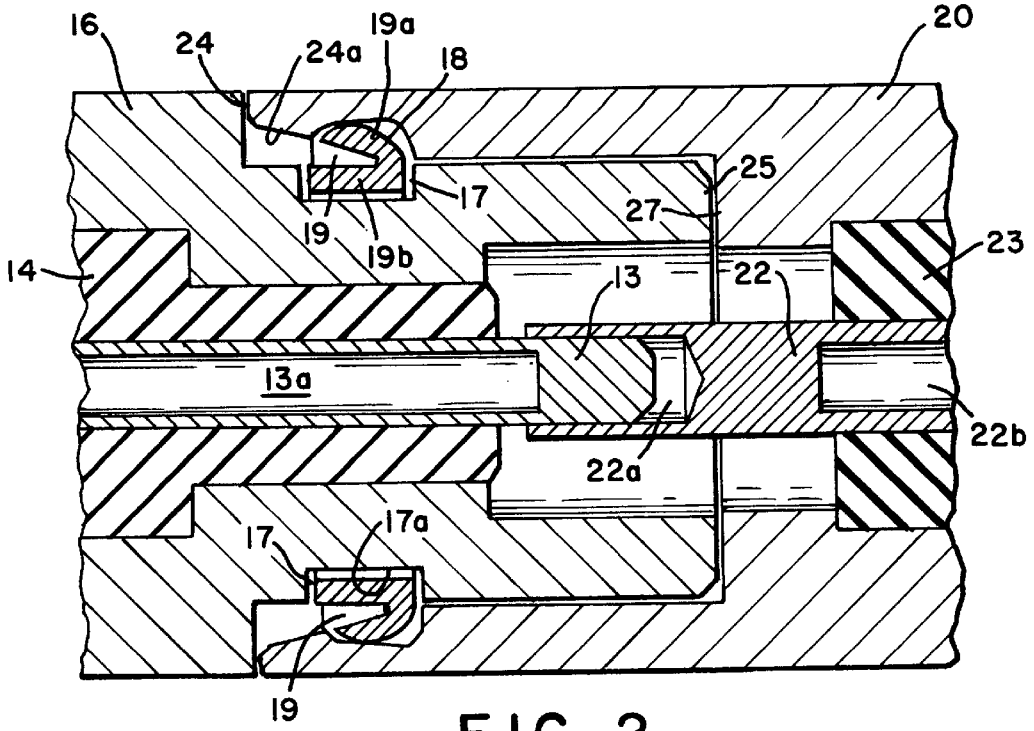
FIG. 2 is a longitudinal cross-sectional view of the two connector members of FIG. 1 connected together.

To engage and connect the connector members 11 and 12, an axial force is applied to the main body of at least one connector toward the other connector. This force causes the forward portion 25 of plug connector 11 to slide into the annular opening 21*a* of female receptor 12 and engages the male center contact pin 13 in opening 22*a* of female socket 22. Connectors 11 and 12 are designed so that upon complete insertion of plug connector 11 into receptacle connector 12 that circular split spring ring 18 will mate with inner groove 26 of receptacle connector 12 and abut the surface thereof. The spring ring 18 will first be compressed when it contacts end portion 24 and tapered shoulder 24*a* and when it passes the shoulder will, because of its resiliency, expand into groove 26 providing a locking connection between the plug connector 11 and receptacle connector 12. The connected assembly is shown in FIG. 2.

When it is desired to disconnect the connectors, the plug connector 11 and receptacle connector 12 are provided with a pulling axial force which overcomes the resistance of the spring ring 18, thus separating the connectors. Conversely to the connecting of the connectors, spring ring 18 is compressed by the downward sloped surface of annular opening 26 and then expands to its original size as it passes shoulder 24*a*.

The notch 19 in the spring ring 18 has been found to significantly reduce the force necessary to connect or disconnect the connectors compared to conventional compression rings while still maintaining excellent locking of the connectors. The lower force enables easier connecting and/or disconnecting the connectors and minimizes any damage to either connector or to the structure to which the connector may be attached. This is especially important if one of the connectors, typically, the female connector, is connected to a printed circuit board or other electronic component from which the other, e.g., plug connector, is disconnected.

Figure 4A:
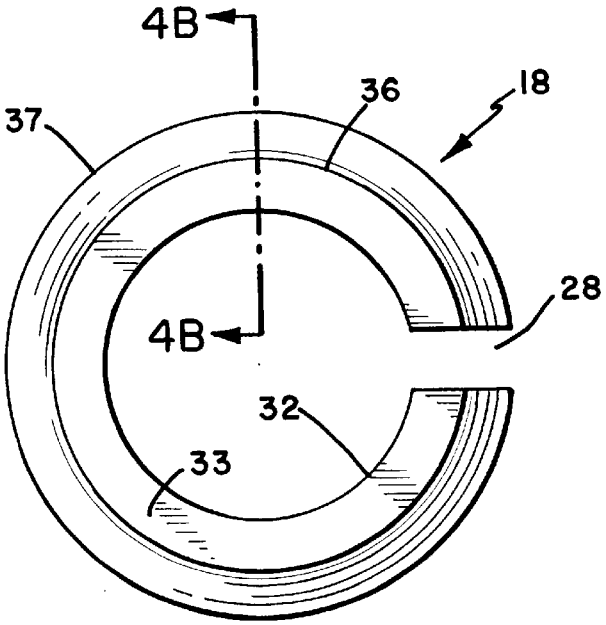
FIG. 4A (PRIOR ART)
FIG. 4A is a front elevational view of a conventional split circular spring ring used in plug and jack connectors.
Figure 4B:
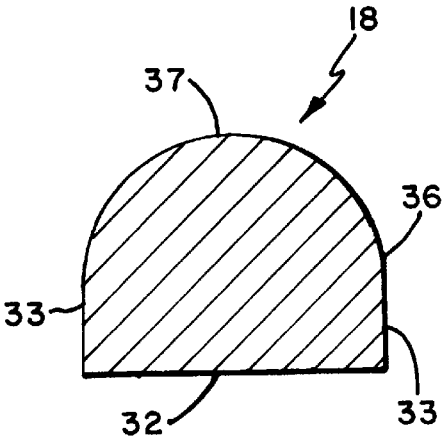
FIG. 4B (PRIOR ART)
FIG. 4B is an enlarged cross-sectional view of the split spring ring of FIG. 4A taken along lines 4B—4B.

FIGS. 4A and 4B show a conventional spring ring 18 of the prior art. The ring has parallel opposed walls 33 and an outer curved peripheral edge 37 and an inner edge 32. The spring ring also contains a longitudinal opening 28 which allows the spring ring to be compressed or even expanded depending on the forces which are applied to the ring. Typically, compressive forces are applied to the ring and the ring caused to contract in diameter after which the ring expands usually to its original size when the force is removed. As can be seen from the cross-sectional view shown in FIG. 4B, a conventional ring starting at inner edge 32 and going toward the periphery of the ring 37 has substantially straight sidewalls 33 until a curved peripheral edge is formed starting at point 36.

In use, the conventional spring ring is deformed when a connecting or disconnecting force is applied to the ring causing the ring to contract when a shoulder or other part of the jack connector is contacted. If, for example, the ring is moved to the right against a shoulder 24*a* such as shown in FIG. 1, the ring will contact the shoulder at the curved edge 37 of the ring and as the ring continues to move around the periphery 37 of the ring until the shoulder is passed and the ring is seated in the groove 26 of FIG. 1.

Figure 3A:
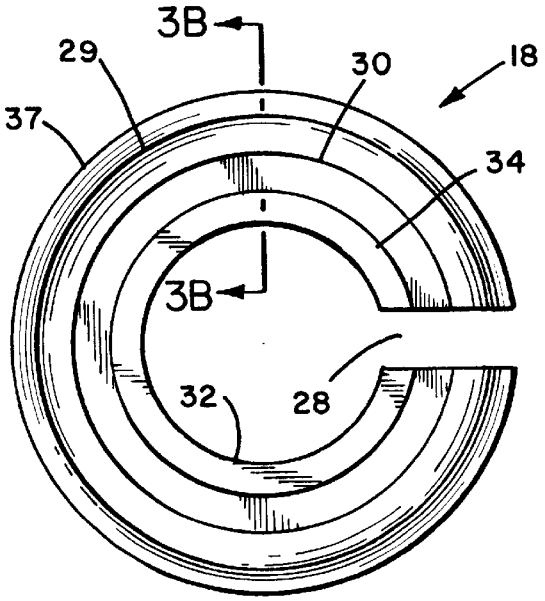
FIG. 3A is a front elevational view of a split circular spring ring of the present invention.
Figure 3B:
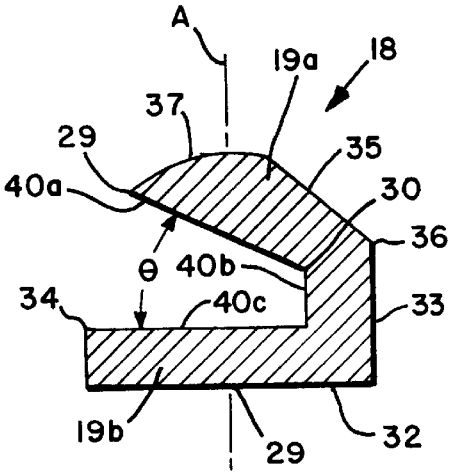
FIG. 3B is an enlarged cross-sectional view of the split spring ring of FIG. 3A taken along lines 3B—3B.

Referring to FIGS. 3A and 3B, a circular split spring ring 18 of the invention is shown. The spring ring 18 includes a longitudinal split 28 forming a C-shaped ring to allow compression of the ring and a reduction of the ring diameter. The circumferential notch 19 provides a second spring action of the spring ring by movement of upper ring portion 19*a* toward base 19*b* of the ring when a force is applied and enables the use of less force for connecting or disconnecting compared with connectors using conventional spring rings. It is preferred that the notch extend to the midpoint 29 of the ring and more preferred that it extend past the midpoint A of the ring.

Referring again to FIGS. 3A and 3B which show a preferred spring ring 18 of the invention, the ring has an inner edge 32 and outer peripheral curved edge 37. Starting at the inner edge 32, the ring has a substantially straight sidewall 33 up to point 36. The ring then has an inwardly angularly disposed flat surface 35 followed by a curved peripheral surface 37 terminating at point 29. A notch is formed starting at point 29 extending to point 34 by notch walls 40*a*, 40*b* and 40*c*. Notch 19 provides an opening so that when the spring ring 18 is compressed upper ring portion 19*a* (wall 40*a*) moves toward surface 40*c* and base ring portion 19*b* compressing the ring 18. This compression spring action coupled with compression of the ring as shown for the conventional ring shown FIGS. 4A and 4B provides a double spring action for both the connect and disconnect operations. The double spring action significantly reduces the connection and disconnection forces required to connect or disconnect the connectors while still providing excellent locking together of the connectors. The upper wall 40*a* forms an angle θ with lower wall 40*c* of preferably less than 90° typically about 10–30°, preferably 17°.

While any ring and shape notch may be employed to achieve the connect-disconnect properties of the spring ring of the invention, a preferred configuration is shown in FIG. 3B. Accordingly, it is preferred that a flat surface 35 be provided with a rounded surface instead of the conventional rounded surface as shown in FIG. 4B. Referring to FIG. 1, it is preferred that this flat edge 35 and the notch 19 be disposed on main body 16 so that the notch faces away from the front end 25 of main body 16. The spring ring 18 of the invention may also be orientated in the other direction so that the notch faces the front end 25 of the main body 16. Regardless of the orientation of the notch, vis-a-vis the front end of main body 16, it is an important aspect of the invention that a peripheral notch 19 be provided in the spring ring 18 to provide the dual spring action properties of the spring ring of the invention and the enhanced connect/disconnect features of the connectors of the invention. The notch 19 is preferred to be on only one side of the ring as shown in FIG. 3B and disposed in groove 17 as shown in FIG. 1.

Figure 5A:
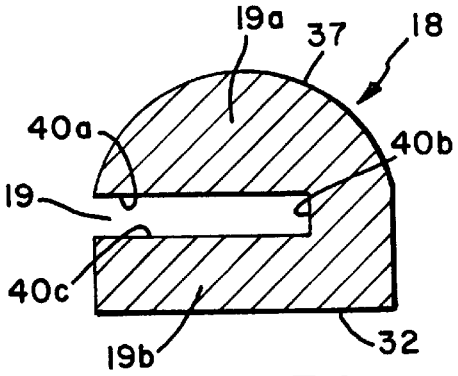
FIG. 5A is an enlarged cross-sectional view of a split ring of the invention.
Figure 5B:
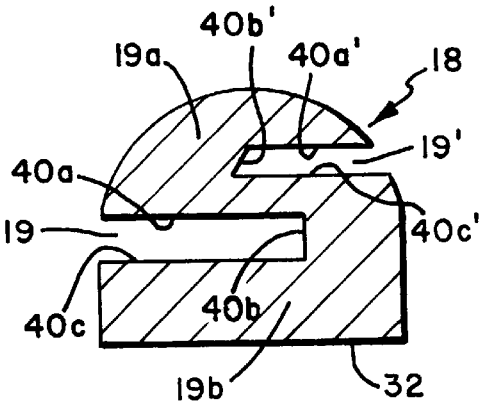
FIG. 5B is an enlarged cross-sectional view of a split ring of the invention.
Figure 5C:
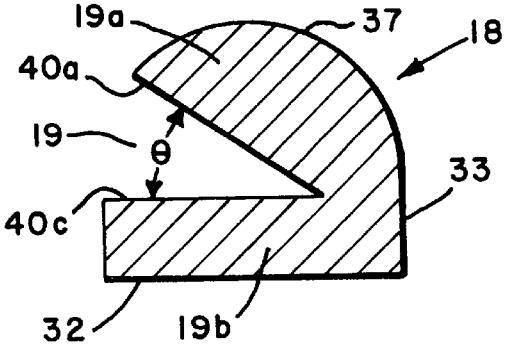
FIG. 5C is an enlarged cross-sectional view of a split ring of the invention.
Figure 5D:
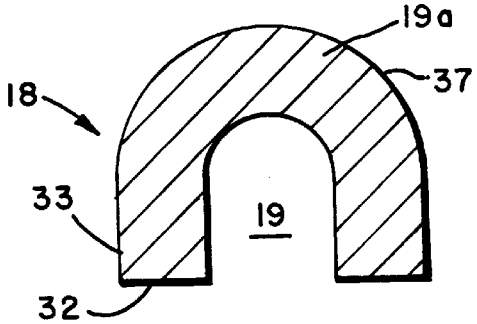
FIG. 5D is an enlarged cross-sectional view of a split ring of the invention.

Other exemplary notched split spring rings 18 which may be used in the invention are shown in FIGS. 5A, 5B, 5C and 5D. FIG. 5A shows a notch 19 having both lower wall 40*c* and upper wall 40*a* essentially parallel to the inner edge 32 of the ring (θ=0). FIG. 5B shows a ring 18 having parallel notch 19 in one side of the ring and a notch 19' in the other side of the ring. This embodiment will provide a relatively uniform force needed for both connecting or disconnecting the connectors. FIG. 5C shows a V-shaped notch 19 in one side of ring 18. FIG. 5D shows a split ring having a vertical notch (opening) 19. Upon compression, ring 18 is compressed as well as upper ring portion 19*a* which is moved downwardly toward edge 32, thus, providing a double spring action. While any type notch or notch position can be employed it is preferred that the notch be positioned so that an axial force forming a radially inward directed force will force the periphery of the ring toward the inner edge of the ring, e.g., the upper wall of the notch 40*a* toward the lower wall 40*c* of the notch. Additionally, while it is highly preferred that the notch extend completely around the ring, it is also contemplated herein that the notch may need only extend partially around the ring or that notch portions be interspersed around the ring.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An electrical connector comprising a plug member having an outer peripheral groove carrying a split spring ring and a jack member having an inner circumferential groove into which the split spring ring mates to secure the plug member to the jack member when the front end of the plug member is inserted into the jack member, the split spring ring comprising a radially deformable split spring ring comprising an inner peripheral edge, which is proximate the outer peripheral groove, and an outer peripheral edge, which is proximate the inner circumferential groove, when the plug and jack members are mated, and two opposed peripheral sides and a notch in at least one of the sides forming a circumferential opening in the side of the split spring ring so that when a radially inward force is provided on the split spring ring at the outer peripheral edge the split spring ring is both compressed and the outer edge compressed toward the notch and the inner edge.

2. The electrical connector of claim 1 wherein the notch extends from the side of the ring to the midpoint of the ring.

3. The electrical connector of claim 2 wherein the notch extends past the midpoint of the ring.

4. The electrical connector of claim 1 wherein the notch faces away from the front end of the plug member.

5. The electrical connector of claim 1 wherein the ring has a flat inner edge and a rounded outer edge.

6. The electrical connector of claim 5 wherein the sides are parallel.

7. The electrical connector of claim 6 wherein the outer edge is partially round and partially flat.

8. The electrical connector of claim 1 wherein the notch is rectangular.

9. The electrical connector of claim 1 wherein the notch is angular.

10. The electrical connector of claim 9 wherein the angle is about 10° to 30°.

11. The electrical connector of claim 10 wherein the angle is about 17°.

12. An electrical connector which is axially mating comprising:

a first connector member having a first electrical contact therein;

a second connector member having an axial bore therein for receiving a first member and a second electrical contact therein for electrical connection with said first electrical contact upon mating of said first and second connector members;

an outer groove in the periphery of said first connector member;

an inner circumferential groove in said second connector member; and radially deformable split spring ring means carried by the outer groove in said first connector member wherein the inner diameter of the spring ring is slightly larger than the inner diameter of the groove wherein the split spring ring comprises an inner peripheral edge, which is proximate the outer peripheral groove, and an outer peripheral edge, which is proximate the inner circumferential groove, when the first connector member and second connector member are mated, and two opposed peripheral sides and a notch in at least one of the sides forming a circumferential opening in the side of the split spring ring so that when the first connector is slideably engaged with the second connector, the split spring ring is contacted with the second connector providing a radially inward force on the split spring ring with the split spring ring being both compressed and the outer edge compressed toward the notch and the inner edge with the spring ring then mating with the inner circumferential groove of the second connector member when the first connector member and second connector member are mated.

13. A radially deformable split spring ring for electrical connectors comprising a plug member and a jack member wherein the spring ring is disposed in an outer peripheral groove of the plug member and the spring ring mates in an inner circumferential groove of the jack member, the split spring ring comprising an inner peripheral edge, which is proximate to the outer peripheral groove, and an outer peripheral edge, which is proximate the inner circumferential groove, when the plug member and jack member are mated, and two opposed peripheral sides, and a notch in at least one of the sides forming a circumferential opening in the side of the split ring so that when a radially inward force is provided on the split spring ring the split spring ring is both compressed and the outer peripheral edge compressed toward the notch and the inner peripheral edge.

14. The split spring ring of claim 13 wherein the notch extends from the side of the ring to the midpoint of the ring.

15. The spring ring of claim 14 wherein the notch extends past the midpoint of the ring.

16. The spring ring of claim 13 wherein the ring has a flat inner edge and rounded outer edge.

17. The spring ring of claim 16 wherein the sides are parallel.

18. The spring ring of claim 17 wherein the outer edge is partially round and partially flat.

19. The spring ring of claim 13 wherein the notch is rectangular.

20. The spring ring of claim 13 wherein the notch is angular.

21. The spring ring of claim 20 wherein the angle is about 10° to 30°.

22. The spring ring of claim 13 wherein the spring contains at least one notch on each side of the ring.

23. A radially deformable split spring ring for electrical connectors comprising a plug member and a jack member wherein the spring ring is disposed in an outer peripheral groove of the plug member and the spring ring mates in an inner circumferential groove of the jack member, the split spring ring comprising an inner peripheral edge, which is proximate to the outer peripheral groove, and an outer peripheral edge, which is proximate the inner circumferential groove, when the plug member and jack member are mated, and two opposed peripheral sides, and a vertical notch in the inner edge forming a circumferential opening in the inner edge of the split ring so that when a radially inward force is provided on the split spring ring the split spring ring is both compressed and the outer edge compressed toward the notch and the inner edge.

* * * * *